United States Patent [19]

Cowan

[11] Patent Number: 4,735,370

[45] Date of Patent: Apr. 5, 1988

[54] TAKE-UP MECHANISM

[75] Inventor: Larry C. Cowan, Hickory Grove, S.C.

[73] Assignee: John Brown Inc., Warwick, R.I.

[21] Appl. No.: 79,897

[22] Filed: Jul. 31, 1987

[51] Int. Cl.[4] ..... B65H 54/02; B65H 54/40; B65H 59/00

[52] U.S. Cl. ..... 242/18 R; 242/43 R; 242/45

[58] Field of Search ..... 242/18 R, 25 R, 43 R, 242/45, 47, 54 R, 158 R, 158.1, 158.2, 158.3, 158.4 R, 158.4 A, 158.5

[56] References Cited

U.S. PATENT DOCUMENTS

| | | | |
|---|---|---|---|
| 3,193,209 | 7/1965 | Hambach | 242/18 R |
| 3,265,315 | 8/1966 | Mueller | 242/18 R |
| 3,281,086 | 10/1966 | Goodman et al. | 242/18 R |
| 4,470,553 | 9/1984 | Boggs et al. | 242/45 X |
| 4,518,126 | 5/1985 | Marshall | 242/18 R |

*Primary Examiner*—Stanley N. Gilreath
*Attorney, Agent, or Firm*—Burnett W. Norton

[57] ABSTRACT

A take-up mechanism for winding strand material at low speeds comprising a take-up spindle and traverse mechanism driven by a torque motor having a flywheel interconnected in the drive system is described. The flywheel controls power fluctuation during the strand winding operation and provides for a substantially uniform tension on the yarn strand during winding.

5 Claims, 1 Drawing Sheet

TAKE-UP MECHANISM

FIELD OF INVENTION

This invention relates to new and useful improvements in a take-up mechanism for controlling the winding speed and tension of a strand being wound onto a yarn package such as a spool or tube positioned on a take-up spindle. More particularly, the take-up mechanism of this invention, designed for low-speed operation, utilizes a torque motor drive interconnected with a flywheel to provide substantially uniform strand speed and tension while winding at a constant power output.

In this specification the term "strand" is employed in a general sense to relate to all kinds of elongated strandular materials including yarns, fibers, tapes, filaments, and the like.

BACKGROUND OF INVENTION

In the winding of strand material onto a package, it is necessary to compensate for variation in winding conditions, for example as the traverse mechanism utilized reaches a cross-over or reversal point. Take-up machines have been provided, therefore, wherein a strand being wound advances over guide rolls and around a compensator wheel with the tension of the strand loop on the compensator wheel controlling the position of a support arm. In such machines the position of the support arm acts to control the speed of a motor rotating the winding mechanism for effecting winding of the strand. Alternative take-up mechanisms have been suggested such as in U.S. Pat. No. 4,518,126 where a compensator wheel unit includes a mounting arm, a support mounted on the arm for pivotal movement about a first axis which is fixed relative to the mounting arm, and a compensator wheel carried by the support for rotation relative to the support and for pivoting with the support along the fixed axis. The winding speed is controlled by the tension of the strand loop through a control device. All of these strand winding devices operate at high or relatively high speeds. Moreover, these compensator systems, being relatively complex, add substantially to the cost of the take-up mechanism.

Accordingly, a take-up mechanism capable of winding at slow speeds essential for some strand materials, such as carbon fibers, which is simple in construction and low in cost, but yet will compensate for variations in winding conditions, is needed.

SUMMARY OF THE INVENTION

In accordance with the present invention there is provided a take-up mechanism primarily adapted for operation at slow speeds of from about 0.2 to about 7.0 meters per minute. Take-up mechanisms operating at such low speeds are desirable in the winding or packaging of certain strand materials such as carbon fibers. Carbon fibers, because they are very fragile, must be wound without any substantial tension variation.

The take-up mechanism of the present invention utilizes a torque motor drive for driving a spindle for carrying the yarn package and a traverse for laying down the strand material. The power output of the motor is set by adjusting the applied voltage. At the low speeds of operation used for winding carbon fiber strands, approximately 90–95% of the motor power is utilized in turning the various mechanisms of the take-up, such as the spindle and traverse, and less than about 5–10% is applied to the strand material. However, the power consumed by the different mechanisms of the take-up varies considerably. Thus, as the traverse mechanism reaches a cross-over or reversal point in the packaging, more resistance is encountered. Since the power is set by the applied voltage and is constant at a given diameter, and since more work is consumed by the traverse at the cross-over, the power available to be applied as tension is reduced, causing a fluctuation in the strand tension.

In order to level out the tension applied to the strand, the take-up mechanism of the present invention utilizes a flywheel interconnected into the torque motor drive system. This flywheel, sized according to the output of the torque motor, builds up energy. At a point of high power requirement, i.e., at the cross-over or reversal point, the built-up energy is quickly removed from the flywheel and, accordingly, the power available for application to the strand material remains unchanged, with the strand tension being constant. The used energy is restored slowly from the torque motor.

The take-up mechanism of the invention, therefore, is capable of winding strand material at slow speeds at a constant voltage while maintaining substantially uniform tension on the strand material throughout the winding, including at the cross-over or reversal point. The mechanism is simple in construction and low in cost.

Figure 1:
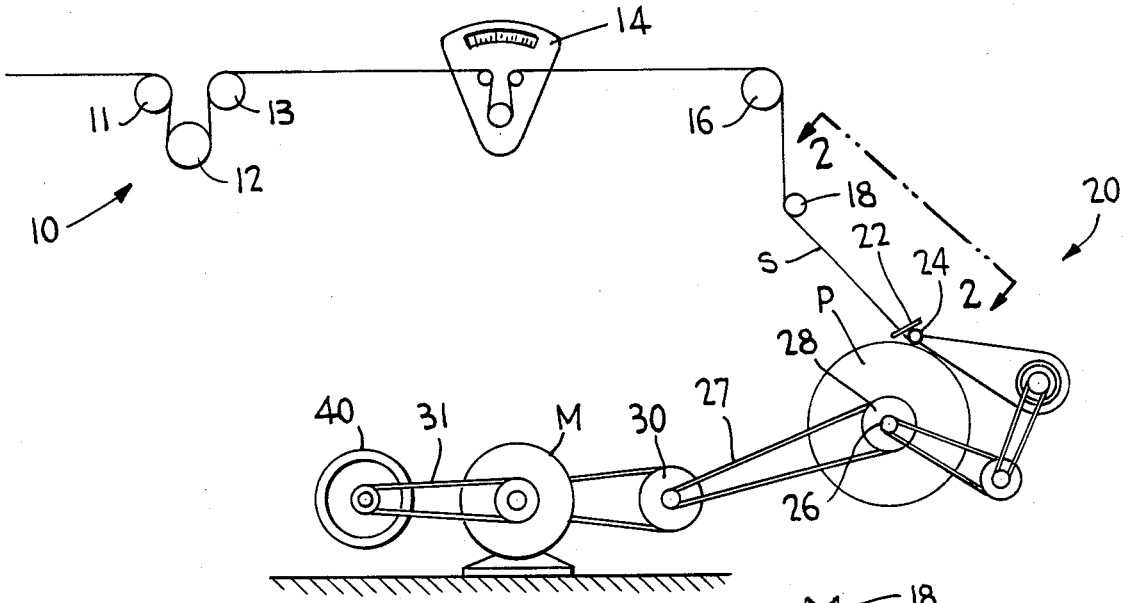
FIG. 1 is a side schematic view of a take-up mechanism according to the present invention illustrated with a strand material to be wound being supplied.
Figure 2:
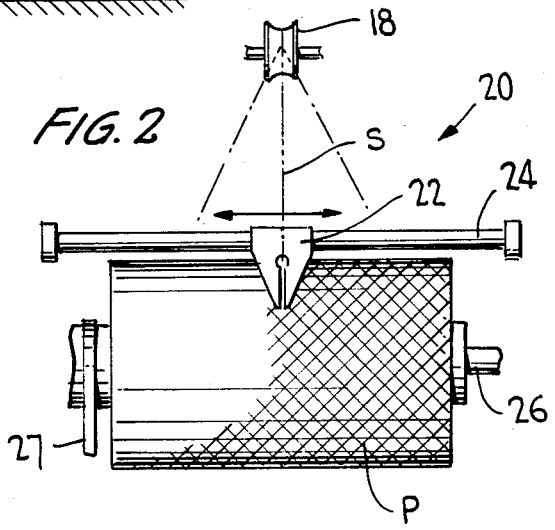
FIG. 2 is a view generally along line 2—2 of FIG. 1.

Referring to the drawing, in FIGS. 1 and 2 the improved take-up mechanism includes a yarn roller means 10 comprising three rollers 11, 12 and 13, a tensiometer 14 for measuring the strand tension, guide rolls 16 and 18 for guiding a strand material, traverse 20 having a strand guide 22 movable along rail 24 for laying down a yarn strand S of, for example, carbon fibers onto a yarn package P carried by a spindle 26. A torque motor M is connected to a shaft 28 on spindle 26 by belt 27 through a speed reducer 30. The torque motor M is also connected by belt 31 to a flywheel 40.

In operation, a strand material S passes from a strand delivery source, not shown, over feed roller means 10 through tensiometer 14 and guide rolls 16 and 18 to be laid down onto package P by traverse 20. The power output of the torque motor is adjusted to approximately 2.5 kg/cm. The spindle is operated at low speeds of about 0.2 to about 7.0 meters per minute. At this speed approximately 90–95% of the power of the torque motor M which is controlled by adjusting the applied voltage through a suitable Variac, not shown, is utilized in turning the spindle and traverse. The remaining 5–10% of the power is applied to the strand material.

Without utilizing a flywheel, since the power output is set by the applied voltage and is constant at a given diameter, and since more work is consumed as the traverse reaches the cross-over or reversal point, the power available for applying tension to the strand material is reduced and, accordingly, wide variations in tension are experienced during the winding. With the addition of the flywheel and the build-up of energy in the flywheel, when additional power is required energy is quickly available for use from the flywheel. However, when less energy is again demanded, the lost energy is slowly restored to the flywheel from the torque motor. This leads, therefore, to a substantial level strand tension throughout winding.

Figure 3:
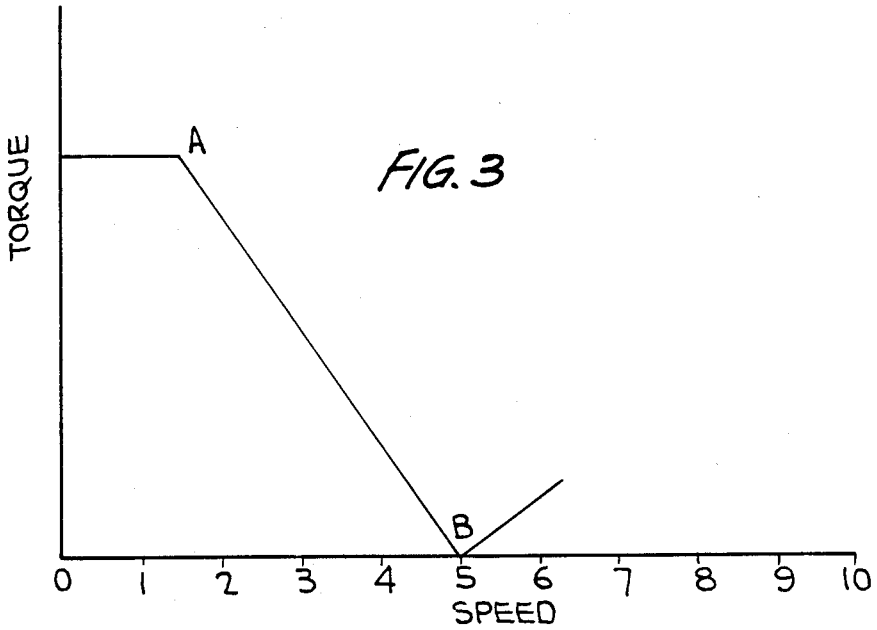
FIG. 3 is a graph illustrating the torque speed relationship of a torque motor drive system.

FIG. 3 illustrates a typical torque speed curve. As shown, the torque as is conventional with a typical torque motor, will remain substantially constant at a given voltage and at relatively low speeds. However, since power is equal to torque X rpms, as the speed increases the torque then decreases at approximately a sixty degree angle to a theoretical zero torque between points A and B. A winding device according to this invention will usually operate within the middle two-thirds of the A-B line. The flywheel interconnected into the drive system by proper sizing will provide a leveling of tension within this region.

Although the assembly is primarily useful in the winding of carbon fibers where low speeds are required and wherein the torque is between 1–5 kg/cm and the flywheel designed to store up to about 25% of the total energy, the principle can be used with the winding of other strand materials.

As will be apparent to one skilled in the art, various modifications can be made within the scope of the aforesaid description. Such modifications being within the ability of one skilled in the art form a part of the present invention and are embraced by the appended claims.

It is claimed:

1. A take-up mechanism for winding a strand material on a take-up spindle at low speeds comprising (a) a strand take-up spindle, (b) a traverse, and (c) a drive system for driving said spindle and traverse, said drive system comprising a torque motor, means for adjusting the voltage applied to said torque, means for connecting said spindle and traverse to said torque motor for driving said spindle and traverse, a flywheel and means for connecting said flywheel to said torque motor, said drive system being constructed and arranged to provide energy from said flywheel to said motor during a period of peak power demand on said torque motor when at constant power output and for said flywheel to receive energy from said motor during periods of low power demand so as to provide a substantially uniform tension on a strand material throughout winding.

2. The take-up mechanism of claim 1 wherein the voltage to said torque motor is controlled by a Variac.

3. The take-up mechanism of claim 1 wherein the take-up mechanism is constructed and arranged to operate at speeds between about 0.2 and 7.0 meters per minute.

4. The take-up mechanism of claim 3 wherein the torque motor is designed to produce an operating torque in the range of from about 1 to 5 kg/cm and the flywheel is designed to absorb up to about 25% of such energy.

5. A method of winding a strand material on a take-up package at low speeds comprising (a) providing a spindle and traverse mechanism, (b) providing a drive system for driving said spindle and traverse mechanism, (c) connecting said driving system to said spindle and traverse mechanism, said drive system comprising a torque motor, means for adjusting the voltage applied to said torque motor and a flywheel interconnected with said torque motor, (d) winding a strand material at a speed of from about 0.2 to about 7.0 meters per minute, and (e), while winding, providing energy from said flywheel to said motor during a period of peak power demand on said torque motor when at constant power output and providing energy to said flywheel from said motor during periods of low power demand to obtain a substantially uniform tension on said strand material throughout winding.

* * * * *